US005447262A

United States Patent [19]

Focke et al.

[11] Patent Number: 5,447,262

[45] Date of Patent: Sep. 5, 1995

[54] APPARATUS FOR TRANSPORTING AND BENDING WEB-SHAPED PACKING MATERIAL

[75] Inventors: Heinz Focke, Verden; Henry Buse, Visselhövede, both of Germany

[73] Assignee: Focke & Co. (GmbH & Co.), Verden, Germany

[21] Appl. No.: 128,962

[22] Filed: Sep. 30, 1993

[30] Foreign Application Priority Data

Oct. 15, 1992 [DE] Germany ..... 42 34 663.0

[51] Int. Cl.[6] ..... B65B 41/12; B65B 41/18; B65H 27/00

[52] U.S. Cl. ..... 226/87; 226/52; 226/95; 226/119; 270/39

[58] Field of Search ..... 226/87, 52, 118, 119, 226/95; 270/32, 39; 493/180, 357, 359, 360

[56] References Cited

U.S. PATENT DOCUMENTS

| | | | |
|---|---|---|---|
| 3,825,139 | 7/1974 | Geis | 214/731 |
| 4,070,014 | 1/1978 | Takahashi | 270/39 |
| 4,114,355 | 9/1978 | Davies et al. | 53/389 |
| 4,625,902 | 12/1986 | Billberg | 226/2 |
| 4,834,276 | 5/1989 | Logan | 226/76 |
| 4,898,569 | 2/1990 | Focke et al. | 493/361 |

FOREIGN PATENT DOCUMENTS

| | | | |
|---|---|---|---|
| 3441574 | 8/1974 | Austria | 270/39 |
| 372688 | 6/1990 | European Pat. Off. . | |
| 408944 | 1/1991 | European Pat. Off. . | |
| 441136 | 8/1991 | European Pat. Off. . | |
| 547168 | 5/1930 | Germany . | |
| 1177464 | 9/1964 | Germany . | |
| 1223854 | 9/1966 | Germany . | |
| 3716897 | 12/1988 | Germany . | |
| 3735674 | 5/1989 | Germany . | |
| 3832533 | 3/1990 | Germany . | |
| 3910986 | 10/1990 | Germany . | |
| 4039133 | 6/1991 | Germany . | |
| 4003192 | 8/1991 | Germany . | |
| 346474 | 6/1960 | Switzerland . | |

*Primary Examiner*—Daniel P. Stodola
*Assistant Examiner*—Thomas E. Dunn
*Attorney, Agent, or Firm*—Sughrue, Mion, Zinn, Macpeak & Seas

[57] ABSTRACT

Apparatus for transporting a material web having lateral depressions (25, 27) arranged at regular distances from one another. For the transport of a material web (10, 35) of this type in the correct position, the web bears on a conveying drum (28) which has elevations (29, 30) for positive penetration into the depressions (25, 27). In a material web (10, 35) consisting of partially prepunched blanks (11), the conveying drum (28) serves, in cooperation with an auxilary drum (51), for forming bending points (49, 50), the material web (10, 35) being capable of being grasped by suction bores (52, 53), offset relative to one another in the circumferential direction, of the conveying drum (28), on the one hand, and of the auxiliary drum (51), on the other hand.

12 Claims, 4 Drawing Sheets

APPARATUS FOR TRANSPORTING AND BENDING WEB-SHAPED PACKING MATERIAL

BACKGROUND OF THE INVENTION

The invention relates to an apparatus for transporting material webs, especially webs of packaging material, having lateral recesses and/or orifices and/or projections arranged at regular distances from one another, by means of endless conveyors, especially by means of at least one conveying drum, the material web bearing on the endless conveyor during transport.

The exact precisely positioned transport of material webs is especially important in packaging technology when the material web serves for the production of blanks. The blanks are conventionally provided with a print, by means of which the exact separation of the blanks from the material web is brought about. With material webs made of paper, these are provided, for the exact control of conveying and driving members, with print marks which are sensed by stationary print-mark readers.

The invention is concerned with the transport of material webs made especially of thin cardboard for the production of corresponding blanks, primarily for hinge-lid packs for receiving cigarettes. The blanks for this type of pack have throughout the world a characteristic construction with a special shaping in the end regions of the elongate blanks. The special design characteristic stems, on the one hand, from a projection arranged at the end on the lid side and intended for a lid inner tab and, on the other hand, from oblique faces in the region of lateral folding tabs (side tabs). When material webs having blanks oriented transversely to the longitudinal direction of these are formed from a blank of this type, projections and depressions are obtained at the edges. One example of such a material web is the subject of U.S. Pat. No. 4,898,569. In this example, the blanks within the material web are prepunched not only at the longitudinal edges of the latter, but also in the transverse direction by making the punchings, conventional in a hinge-lid pack, for the lateral folding tabs. Furthermore, the connection between adjacent blanks within the material web is designed so that only residual connections, namely small severable or tear-off material webs, remain.

SUMMARY OF THE INVENTION

The object on which the invention is based is to allow a correctly positioned transport of material webs of the type mentioned in the introduction, without optoelectronic control members, especially in order to produce a formation of blanks folded in a zigzag-shaped manner.

To achieve this object, the apparatus according to the invention is characterised in that there are arranged on the top side of the endless conveyor elevations or projections, the geometrical shape of which corresponds to that of the recesses and orifices and which penetrate positively into the recesses and/or orifices during the transport of the material web.

In the invention, therefore, by virtue of the predetermined projections and depressions located at the edges, the material web is transported in the correct position into the recesses of the material web as a result of the positive engagement of correspondingly, namely suitably, designed projections. Since, by virtue of the design of blanks for hinge-lid packs, characteristic projections and depressions are formed on both sides of a material web formed from these, the endless conveyor, namely the conveying drum, is designed, according to the invention, with lateral edge elevations which correspond exactly to the contour of the material web.

This design of the conveying drum makes it possible to use the latter to produce zigzag-shaped formations of a material web consisting of blanks for hinge-lid packs, for example in order to form a temporary store. For this purpose, there are provided, according to the invention, two cooperating drums which transport the material web in the correct position and which have suction members arranged offset relative to one another, and these take effect alternately on one side and the other of the successive blanks, in such a way that the material web is folded in a zigzag-shaped manner as a result of the interaction of the section members.

Further particulars of the invention relate to the design of the endless conveyors for the material web and of members for receiving a zigzag-shaped formation of the material web.

An exemplary embodiment of the apparatus according to the invention is explained in more detail below by means of the drawings. In these:

DESCRIPTION OF A PREFERRED EMBODIMENT

Figure 1:
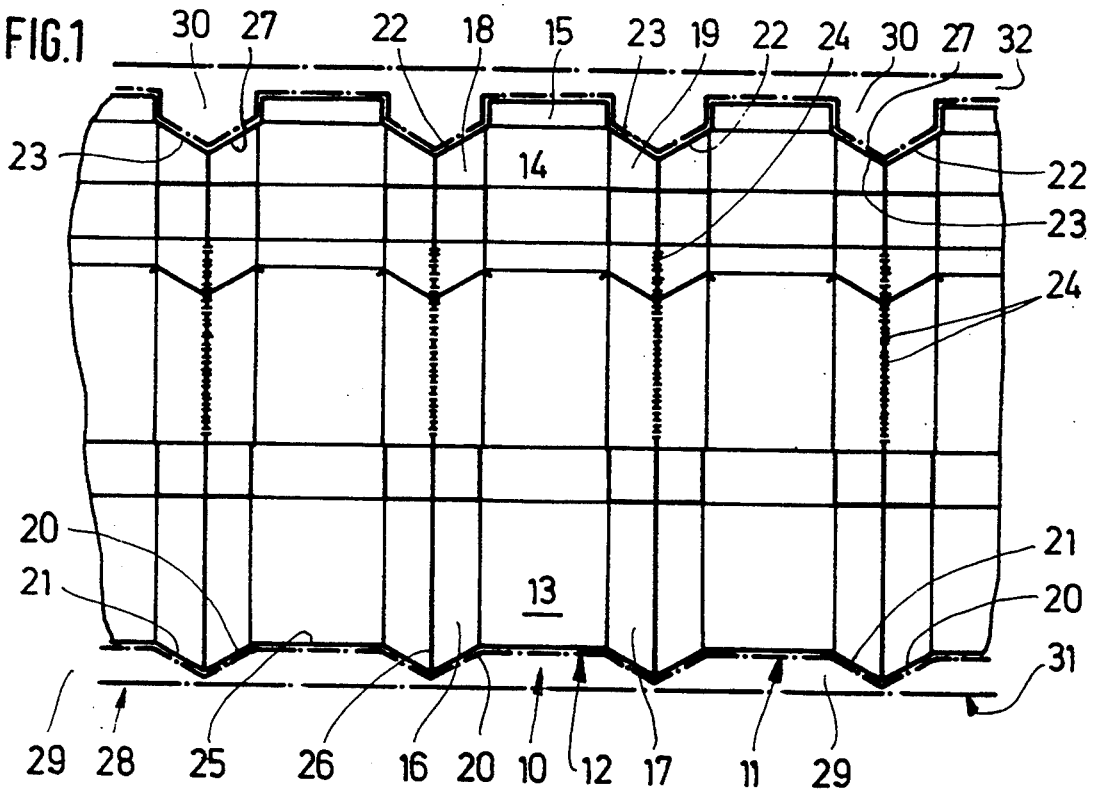
FIG. 1 shows a cutout from a material web consisting of blanks on an endless conveyor in horizontal projection.

The present exemplary embodiment relates to the handling of material webs 10 consisting of blanks 11 for hinge-lid packs for receiving cigarettes. The elongate, approximately rectangular blanks 11 are directed transversely within the material web.

The blanks 11 for hinge-lid packs have a characteristic construction. An elongate middle piece 12 consists at one end (edge of the material web 10) of a front wall 13 and, opposite this, of a lid front wall 14 having a lid inner tab 15 arranged at the free edge of the latter. With the exception of the region of lid inner tab 15, the middle piece 12 is provided with lateral folding tabs. Of these, side tabs 16, 17 in the region of the front wall 13 and lid side tabs 18, 19 on the opposite side of the blank 11 are of interest here. The side tabs 16 and 17 are limited by outwardly directed or projecting oblique edges 20, 21. The lid side tabs 18, 19 are correspondingly limited respectively relative to the outside and laterally by set-back oblique edges 22, 23.

Furthermore, the blanks 11 are provided with longitudinal and transverse punchings in the region of the lateral folding tabs. The blanks 11 are therefore finished virtually completely. Only in the middle region are the blanks 11 connected to one another, to form the material web 10, via material bridges 24 as residual connections to be severed.

The special design of the blanks 11 results in a material web 10 having special contours at the two longitudinal edges. On one side, the blanks 11 form trapezoidal depressions 25 which are limited by triangular or tapered projections 26. On the opposite side, a triangular depression 27 having legs limited by the lid inner tabs 15 is obtained between adjacent blanks 11.

For exact guidance, especially during the transport of the material web 10, conveying members are provided with projections which penetrate positively and with a fit into the depressions 25 and 27. In the present exemplary embodiment, the material web 10 is transported on the circumference of a conveying drum 28. This is provided at the edges, on one side, with trapezoidal elevations 29 and, on the opposite side, with elevations 30 corresponding in shape and size to the depression 27. The elevations 29 form, on one side of the conveying drum 28, a continuous edge elevation 31. This, together with the inner contour, continuously limits the material web 10 in the entire region of bearing contact on the circumference of the conveying drum 28. The material web 10 is positioned exactly between the elevations 29, 30, that is to say on both sides of the conveying drum 28.

So that, during the transport movement, the penetration of the elevations 29, 30 into the depressions 25, 27 and their emergence from these become easier and mechanical loads on the material web 10 are avoided, the elevations 29, 30 and also the edge elevation 31 are provided, in the regions facing the material web 10, with oblique side faces 33, 34. By means of these, the respective elevations are designed to converge towards the free outside, that is to say with a decreasing cross-section.

Figure 2:
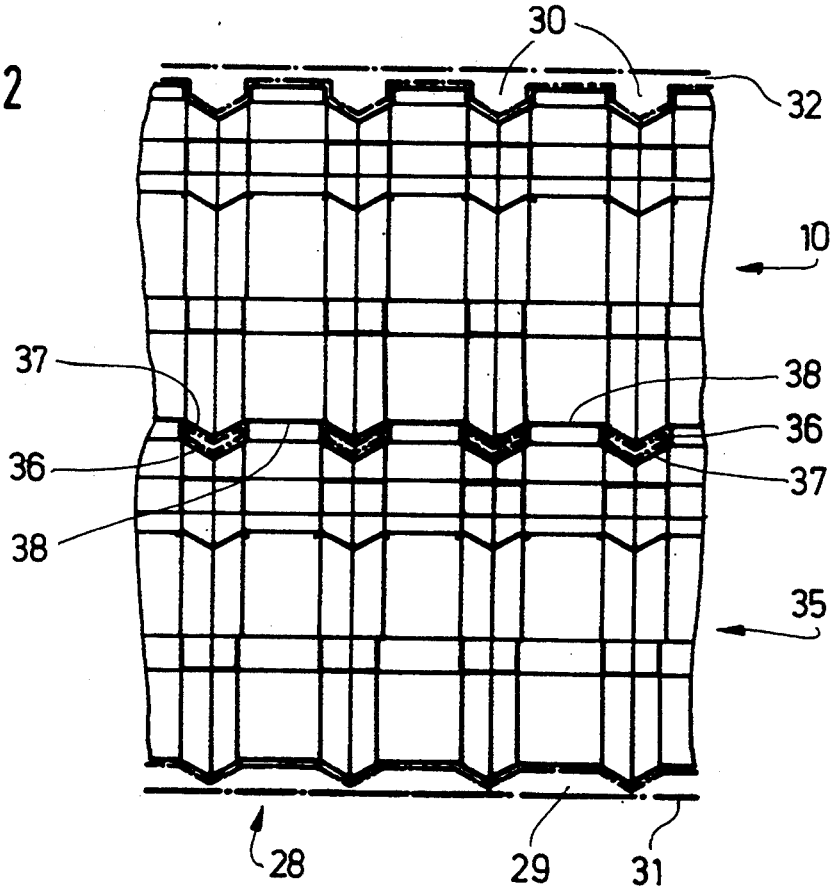
FIG. 2 shows a representation, similar to that of FIG. 1, of the transport of two parallel material webs.

The conveying member for the material web 10, especially the conveying drum 28, can also be designed so that a plurality of, for example two, material webs 10, 35 are transported next to one another. If the blanks 11 are oriented in the same direction within the two material webs 10, 35, an edge design of the conveying drum 28 is obtained in the way already described. However, in the embodiment according to FIG. 2, positive guiding and adjusting members are additionally arranged in the region between the material webs 10 and 35, that is to say in the middle of the conveying drum 28. In the present instance, these are guide bridges 36 of V-shaped cross-section, which penetrate positively into a correspondingly designed V-shaped recess 37 between the two material webs 10 and 35. The recess 37 is obtained in the region of the lid inner tabs 15, being limited by the oblique edges 20 to 23. Moreover, the two material webs 10, 35 are separated from one another in the longitudinal direction by means of a longitudinal cut 38.

The conveying drum 28 does not have to be designed with a complete cylindrical outer surface. As is evident especially from FIG. 3, the conveying drum 28 can have grooves 39, 40, 41 extending in the circumferential direction. Between these are formed, in the middle region, supporting discs 42, 43 which are of cylindrical design and which form corresponding bearing faces for the material web 10. One near-edge groove 39 is limited on the outside by drum disc 32, on the cylindrical circumference of which the elevations 30 are arranged. The opposite near-edge groove 41 is limited by the edge elevation 31.

The above design of the conveying drum 28 with lathe-turned indentations (grooves 39, 40, 41) makes it possible to lift off the material web 10, 33 more easily from the circumference of the conveying drum 28 for the purpose of further transport. In the examplary embodiment illustrated, conveyor bands 44 and 45 penetrate with their ends, namely with deflecting rollers 46, into the grooves 39 to 41 and take over the material web 10, 35. For easier transfer, strip-shaped stationary fenders 47 are arranged in the region of the transfer from the conveying drum 28 to the conveyor bands 44, 45. The fenders 47 penetrate with one end into the grooves 39 to 41. In the present exemplary emodiment, three conveyor bands 44 located next to one another, corresponding to the number of grooves 39 to 41, are provided for transporting away the material web 10, 35.

The apparatus described is especially suitable for producing a zigzag-shaped formation 48 of the material web 10, 35. This formation 48 can serve as a material store, since a large stock of blanks 11 can be accommodated in a confined space. The material web 10 forms bending points 49, 50 in the region between adjacent blanks 11, namely in the region of the residual connections or material bridges 24. The formation 48 is located between upper and lower parallel conveyor bands 44, 45. The bending points 49, 50 designed as folding edges are supported on the conveying strands, driven in the same direction, of the conveyor bands 44, 45. These are driven on the one side for the new production of the formation 48 and on the other side for the break-down of the latter.

The bend formation takes place, here, by means of the conveying drum 28 and an auxiliary drum 51 located opposite or above it. The two drums 28 and 51 lie in one region with the circumferential surfaces close against one another. The auxiliary drum 51 is of a similar design to the conveying drum 28, namely likewise with grooves 39 to 41 and supporting discs 42, 43 located between them. The group of three bands 45 which is arranged above the bands 44 is assigned to the auxiliary drum 51. Deflecting rollers 46 extend partially in the region of the grooves 39 to 41.

Figure 3:
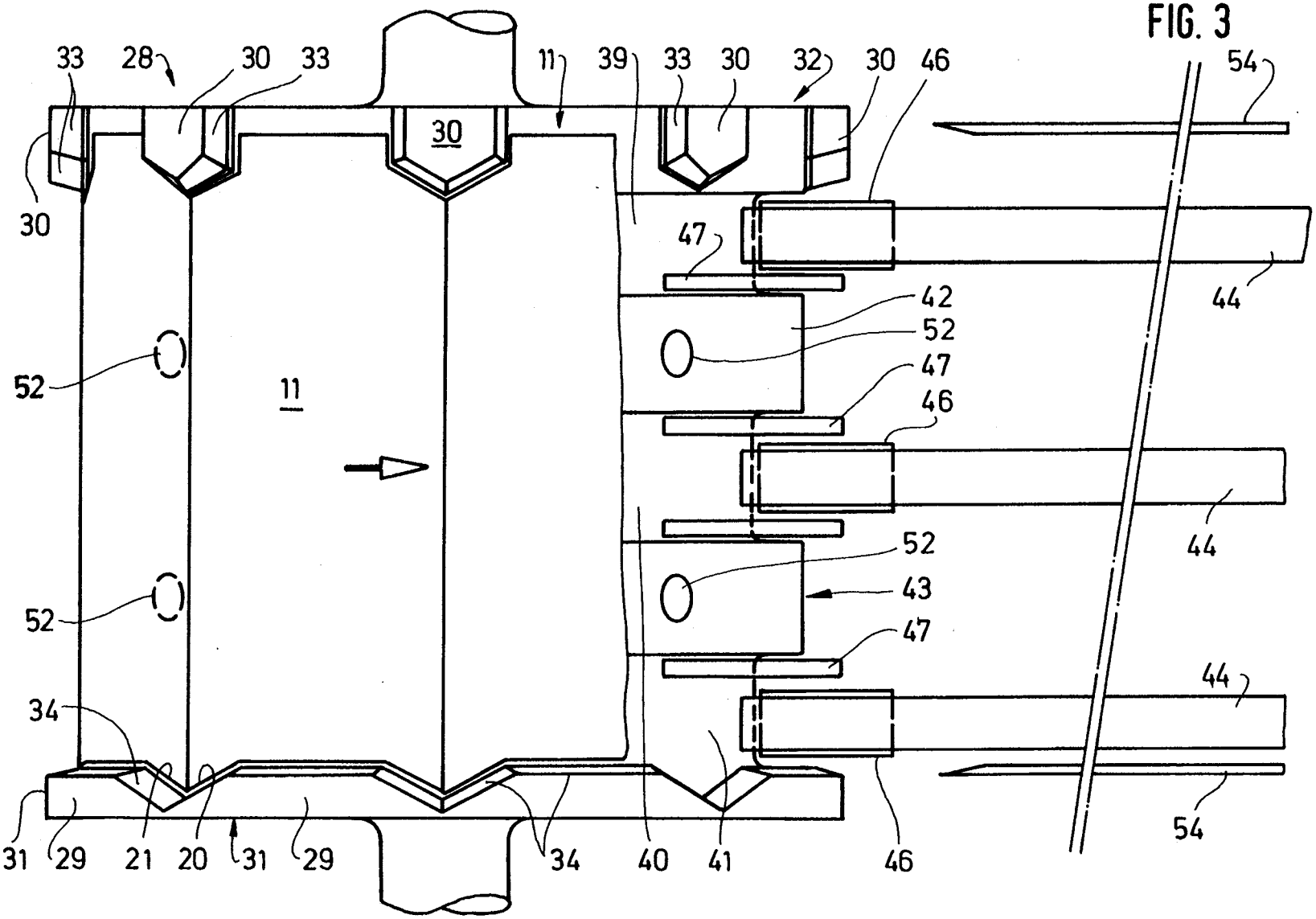
FIG. 3 shows a conveying drum as an endless conveyor for a material web in horizontal projection.
Figure 4:
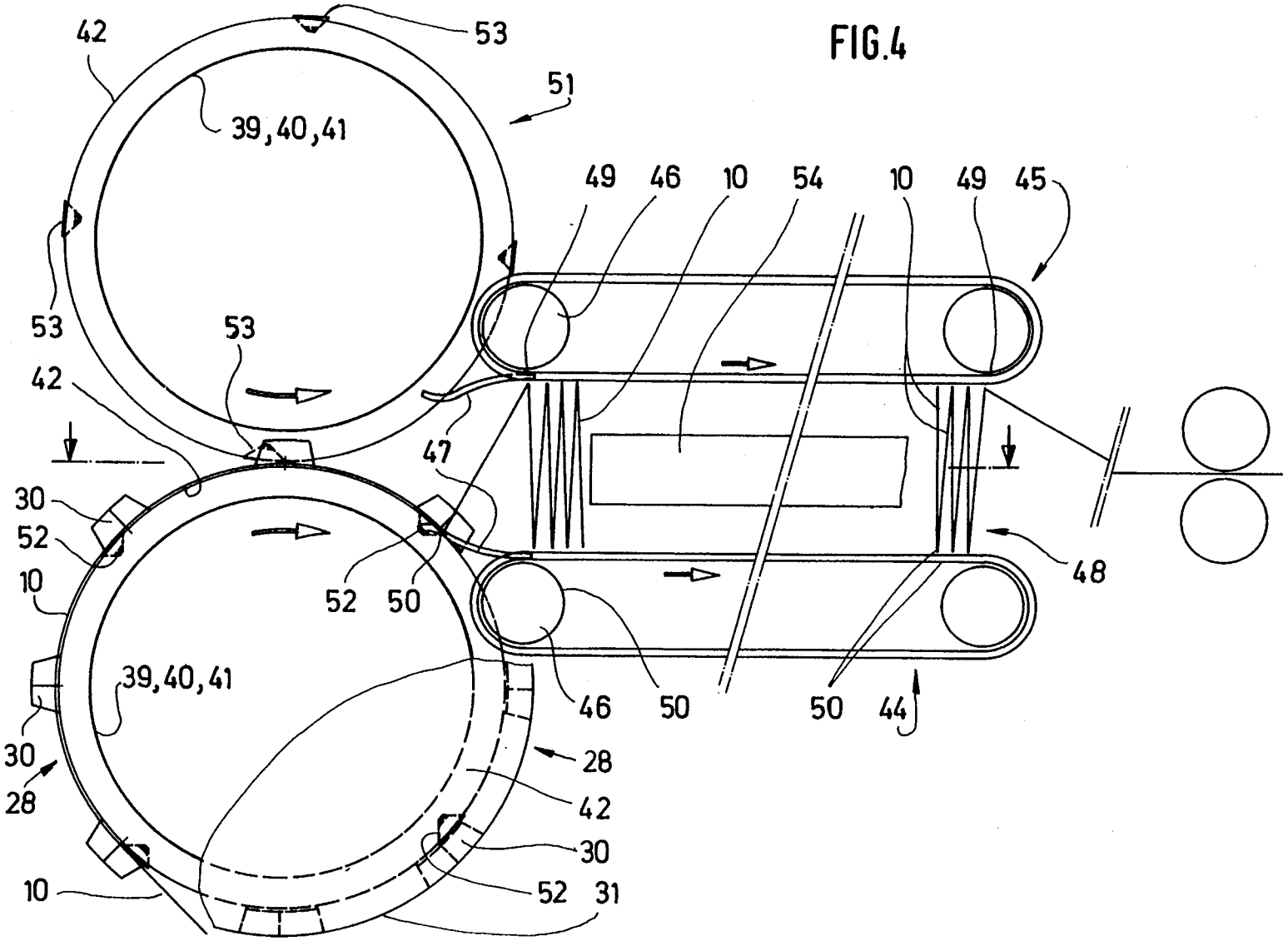
FIG. 4 shows an apparatus for transporting the material web in order to produce a zigzag-shaped formation of the latter.

The material web 10 is fed via the (lower) conveying drum 28. The two drums 28, 51 are provided with holding members for the material web 10, 35, which are arranged distributed along the circumference, namely with suction members or suction bores 52, 53. These are distributed over the width (axial direction) of the drums 28, 51, in such a way that at least two suction bores 52 on the one hand and 53 on the other hand are located next to one another in a common radial plane of the drums (FIG. 3). At the same time, the suction bores 52, 53 are located in the region of the supporting discs 42, 43.

The suction bores 52 on the one hand and 53 on the other hand are arranged respectively offset along the circumference of the drums and at equal distances from one another, the distances being coordinated with the dimensions of the blanks 11 in the longitudinal direction of the material web 10. Furthermore, the suction bores 52 of the conveying drum 28 are arranged offset relative to the suction bores 53 of the auxiliary drum 51, on the other hand, namely exactly "staggered". The relative position in relation to the material web 10 is selected so that a respective suction bore or group of suction bores 52, 53 takes effect, adjacent to an intended bending point 49, 50, on one side of the material web 10, 35 or on the other. As seen in the direction of transport, the suction bores 52, 53 respectively take effect on the front region of the blanks 11 adjacent to the bending point 49, 50 to be formed in the region of the material bridges 24.

Figure 5:
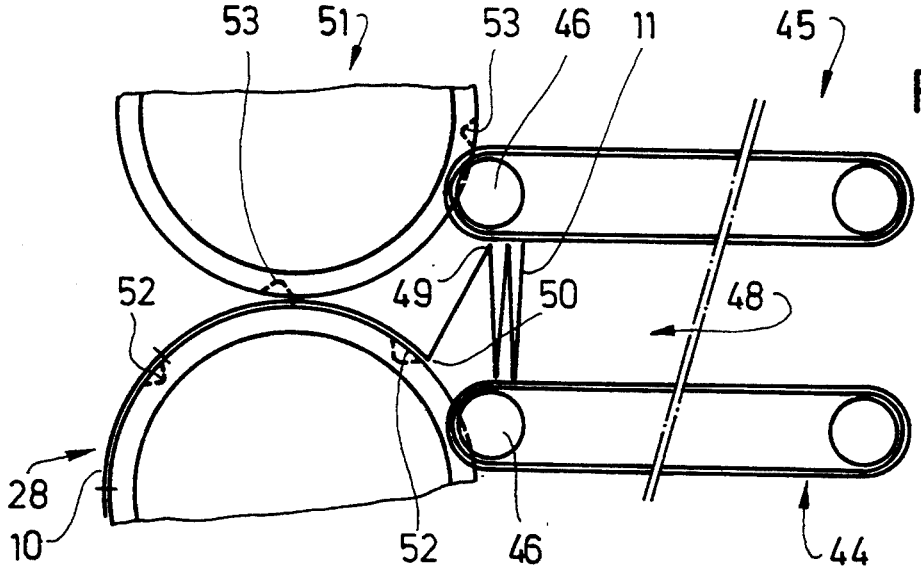
FIGS. 5 to 7 show different positions of details of the apparatus according to FIG. 4 during the production of the zigzag-shaped formation of the material web.
Figure 6:
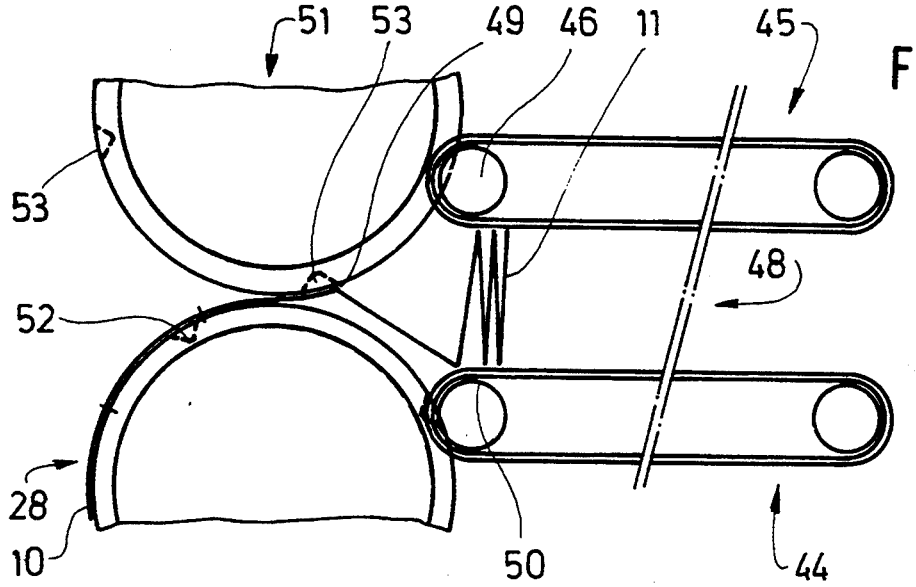
Figure 7:
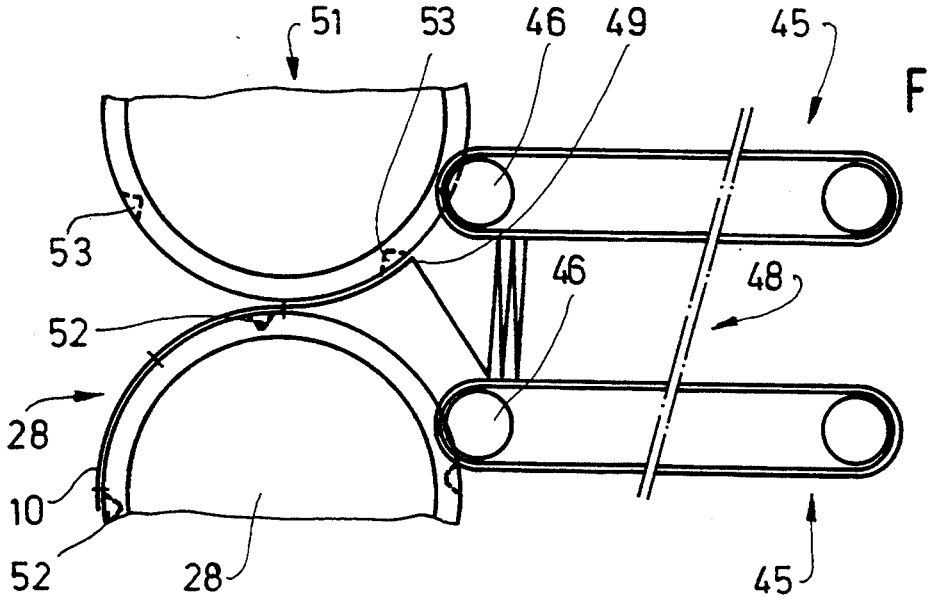

The cycle of the formation of the bending points 49, 50 emerges from FIGS. 5 to 7. The material web 10 is transported, in the position according to FIG. 5, on the circumference of the conveying drum 28, whilst a region of the subsequent blank 11 adjacent to the (lower) bending point 50 to be formed is held by suction bores 52. The subsequent part of the zigzag-shaped formation 48 is held by means of the bending points 49, 50 between the conveyor bands 44, 45. This results in the inevitable formation of the next following bending point 50. Only when the latter has reached the (lower) conveyor band 44 and has been grasped by this is air removed from the effective suction bore 52 of the conveying drum 28 and this region of the material web 10 therefore released. The bending point 50 is then completed by the further transport of the material web 10 between the conveyor bands 44, 45.

At the same time, the blank 11 following in the region of the material web 10 is grasped by a suction bore 53 of the auxiliary drum 51, the said suction bore 53 being located in the corresponding position. The material web is then conveyed with a part region along the circumference of the auxiliary drum 51, a further upper bending point 49 forming as a result of the fixing of the formation 48 (FIGS. 6 and 7). The region of the upper bending point 49 is fed, as a result of the further rotation of the auxiliary drum 51, to the upper conveyor bands 45 and is transferred there to the formation 48 conveyed further.

This operation to form bending points 49, 50 and consequently to produce a zigzag-formation 48 takes place continuously. The conveyor bands 44, 45 can accordingly also be moved continuously. On the side located opposite the drums 28, 51, the material web 10 is brought into the extended position again and conveyed further. The formation 48 is supported laterally by guide rails 54 in the region between the conveyor bands 44, 45.

We claim:

1. An apparatus for transporting a longitudinally extending web (10, 35) of packaging material consisting of interconnected package blanks (11), said web having transversely extending, regularly spaced depressions on both opposite lateral sides thereof, said apparatus comprising:

a rotatable conveying drum (28), having a generally cylindrical outer surface for carrying said web, having a rotational axis extending transversely relative to the carried web, and having two axially opposite lateral edges;

a plurality of regularly circumferentially spaced projections (29, 30) along each of said opposite lateral edges of said drum substantially corresponding in shape and size to said depressions, said projections (29, 30) being constantly and simultaneously in positive engagement with said depressions (25, 27) on said both opposite sides of the carried web to advance the carried web regularly, sychronously, and without slip, and extending both radially outwardly from said cylindrical surface and also axially inwardly from said lateral edges of said drum, each projection having an outer circumferential surface; and means for rotating said drum to transport said web in the longitudinal direction thereof with said projections in constant and simultaneous engagement with the depressions on said both opposite lateral sides of the carried web.

2. The apparatus according to claim 1, wherein each of said interconnected blanks (11) is a blank for a hinge-lid pack having a lid, a front wall (13) and pack side tabs (16, 17), wherein the depressions on one of said lateral opposite sides of the carried webs are trapezoidal depressions (25) defined by the front wall (13) and by oblique edges (20, 21) of the side tabs (16, 17), and wherein said projections on one of said opposite edges of said drum are correspondingly trapezoidal and positively penetrate into said trapezoidal depressions.

3. The apparatus according to claim 2, wherein the depressions on the other of said lateral opposite sides of the carried web are triangular depressions (27) defined by lid inner tabs (15) of longitudinally adjacent ones of the interconnected blanks and by lid side tabs (18, 19) having oblique edges (22, 23), and wherein said projections (30) on the other of said opposite edges of said drum are correspondingly triangular and positively penetrate into said triangular depressions.

4. The apparatus according to claim 3, wherein each of the projections (29, 30) of the conveying drum (28) has obliquely directed side faces (33, 34) converging towards the outer circumferential surface of the projection.

5. The apparatus according to claim 3, wherein said trapezoidal projections are interconnected to form a continuous shoulder for providing a bearing contact surface for an adjacent longitudinal side of the carried web.

6. The apparatus according to claim 3, wherein the triangular projections (30) are circumferentially displaced from the trapezoidal projections (29).

7. The apparatus according to claim 3, wherein another said web is carried adjacent said first web on said conveyor drum (28); and wherein said conveying drum (28) has radially outwardly projecting guide bridges (36) which are located at a midpoint on the cylindrical surface between the adjacent material webs (10, 35) in recesses (37) between the adjacent webs, the guide bridges (36) being of V-shaped design and penetrating into the recesses (37), said recesses being formed between the pack side tabs (16, 17) and the lid side tabs (18, 19) of transversely adjacent blanks (11) of the two webs (10, 35).

8. Apparatus according to claim 1 or 2, characterized in that the conveying drum (28) has first suction bores (52) which open out in said outer surface.

9. The apparatus according to claim 8, further comprising a discharge-conveyor track, and characterized in that the material web (10, 35) is transported into said discharge-conveyor track by the conveying drum (28), thereby producing a zigzag-shaped formation (48) of the material web (10, 35) having bending points (49, 50) between adjacent blanks (11) in the web.

10. The apparatus according to Claim 9, further comprising an auxiliary drum (51) which is located adjacent said conveying drum, and which likewise has second suction bores (53) in its outer surface, the first suction bores (52) of the conveying drum (28), on the one hand, and the second suction bores (53) of the auxiliary drum (51), on the other hand, being arranged offset relative to one another, whilst moving continuously in the same direction, in such a way that, adjacent to an intended bending point (49, 50) between the blanks (11), the material web (10, 35) is grasped alternately on one side and the other by the first and second suction bores (52, 53)

and are transported over a part stage along the circumference of the conveying drum (28) or auxiliary drum (51), thereby forming a bending point (49, 50).

11. Apparatus according to claim 10, characterized in that the auxiliary drum (51) is substantially identical to the conveying drum (28).

12. The apparatus according to claim 1 or 2, characterized in that the conveying drum (28) has grooves (39, 40, 41) which extending circumferentially around the drum, and which are separated from one another by supporting discs (42, 43), the supporting discs (42, 43) forming the outer surface of the conveying drum (28) and a bearing face for the material web (10, 35); and wherein said apparatus comprises discharge-conveyor members (44, 45) penetrating with one end thereof into the grooves (39, 40, 41).

* * * * *